US006262404B1

(12) United States Patent
Higaya et al.

(10) Patent No.: US 6,262,404 B1
(45) Date of Patent: Jul. 17, 2001

(54) INDUCTION HEATING TYPE FIXING DEVICE AND METHOD OF PRODUCING AN INDUCED CURRENT GENERATING MEMBER THEREFOR

(75) Inventors: Toshiaki Higaya, Kanagawa; Tomotaka Takamura, Miyagi, both of (JP)

(73) Assignees: Ricoh Company, Ltd., Tokyo; Tohoku Ricoh Co., Ltd., Shibata-gun, both of (JP)

( * ) Notice: Subject to any disclaimer, the term of this patent is extended or adjusted under 35 U.S.C. 154(b) by 0 days.

(21) Appl. No.: 09/404,726

(22) Filed: Sep. 24, 1999

(30) Foreign Application Priority Data

Sep. 25, 1998 (JP) ..... 10-271957

(51) Int. Cl.[7] ..... H05B 6/36; G03G 15/20

(52) U.S. Cl. ..... 219/619; 219/674; 219/676; 399/330; 29/605; 29/602.1; 336/209

(58) Field of Search ..... 219/619, 618, 219/635, 672, 674, 676; 399/328, 330, 331, 335, 336; 29/602.1, 603.23, 603.26, 605, 606; 336/209

(56) References Cited

U.S. PATENT DOCUMENTS

| | | | | |
|---|---|---|---|---|
| Re. 36,124 | | 3/1999 | Yokoyama et al. . | |
| 5,300,996 | | 4/1994 | Yokoyama et al. . | |
| 5,426,495 | | 6/1995 | Sawamura et al. . | |
| 5,594,540 | | 1/1997 | Higaya et al. . | |
| 5,745,833 | * | 4/1998 | Abe et al. | 219/619 |
| 5,773,796 | * | 6/1998 | Singer et al. | 219/470 |
| 5,826,152 | * | 10/1998 | Suzuki et al. | 399/330 |
| 5,832,354 | | 11/1998 | Kouno et al. . | |
| 5,915,147 | | 6/1999 | Kouno et al. . | |
| 6,169,871 | * | 1/2001 | Higaya | 399/330 |

FOREIGN PATENT DOCUMENTS

| | | |
|---|---|---|
| 2 319 583 | 5/1998 | (GB) . |
| 8-194399 | 7/1996 | (JP) . |
| 9-127813 | 5/1997 | (JP) . |

OTHER PUBLICATIONS

Patent Abstracts of Japan vol. 1998, No. 12, Oct. 31, 1998, JP 10–184662, Jul 14, 1998.

Patent Abstracts of Japan, vol. 1996, No. 11, Nov. 29, 1996, JP 08–179647, Jul. 13, 1996.

Patent Abstracts of Japan, vol. 1998, No. 09, Jul. 31, 1998, JP 10–111610, Apr. 28, 1998.

* cited by examiner

*Primary Examiner*—Philip H. Leung
(74) *Attorney, Agent, or Firm*—Oblon, Spivak, McClelland, Maier & Neustadt, P.C.

(57) ABSTRACT

An induction heating type fixing device for an electrophotographic printer, facsimile apparatus, copier or similar image forming apparatus and an induced current generating member therefore are disclosed. A coil is wound round a bobbin applied with an adhesion preventing material. After the coil has been adhered by nonconductive adhesive by impregnation, the coil and bobbin subassembly is inserted into a hollow cylinder body formed of a heat-resistant insulating material. After the coil has been adhered to the cylindrical body, the bobbin is pulled out to produce the induced current generating member.

36 Claims, 3 Drawing Sheets

INDUCTION HEATING TYPE FIXING DEVICE AND METHOD OF PRODUCING AN INDUCED CURRENT GENERATING MEMBER THEREFOR

BACKGROUND OF THE INVENTION

The present invention relates to an induction heating type fixing device for an electrophotographic printer, facsimile apparatus, copier or similar image forming apparatus. More particularly, the present invention relates to a method of producing an induced current generating member for an induction heating type fixing device and exhibiting a desirable cooling effect. The present invention is applicable even to an induction coil for induction heating equipment in general.

An image forming apparatus of the type using toner for forming a visible image includes a fixing device for fixing a toner image formed on a paper or similar recording medium. Generally, the fixing device includes a heat roller for melting the toner with heat and a press roller pressing the paper against the heat roller while conveying it. The heat roller has thereinside a heater usually implemented by a halogen lamp. The halogen lamp heats the heat roller to a preselected fixing temperature.

However, the conventional heating system using a heater has the following left unsolved. It takes a substantial period of time for the heat roller to reach the fixing temperature (warm-up time), forcing the operator to simply wait without operating the apparatus at all. Another problem is that the heater implemented by a halogen lamp involves a substantial loss and therefore consumes substantial power. This is contrary to the current trend toward energy saving which is highlighted in the environment aspect. In such circumstances, there is an increasing demand for a fixing device featuring high efficiency and short warm-up time.

In light of the above, a fixing method of the kind heating a heat roller formed of conductive metal with an eddy current derived from an electromagnetic wave is attracting increasing attention. This kind of method, i.e., induction heating type fixing method drastically reduces the warm-up time and enhances efficiency and thereby contributes to the solution of environmental problems. One of conventional heat rollers for implementing this fixing method includes an induction coil wound spirally round a bobbin. When a high frequency current is caused to flow through the induction coil adjoining the inner periphery of the heat roller, a high frequency magnetic field is formed and induces an eddy current in the heat roller. As a result, the heat roller itself is heated by Joule heat on the basis of the skin effect of the roller itself.

The induction coil has customarily been formed of copper or similar highly conductive material. The problem with this kind of material is that a great high frequency current flowing through the induction coil causes the coil to heat despite high conductivity. This, coupled with the radiation heat of the heat roller, is apt to damage the insulation layer of the coil and bring about short-circuiting. There has been proposed to cause cooling air to flow through the inside of the induction coil. To enhance the cooling effect, a bobbin for wrapping the induction coil may be omitted in order to efficiently release heat output from the coil to the outside, an also proposed in the past. Although this kind of configuration, in principle, enhances the coil cooling effect to a remarkable extent, it has heretofore been considered difficult to produce. Such a scheme has not been practiced with an induction coil for an induction heating type fixing device.

As for the above coil or bobbinless coil, a mold coil is also known in the art and customarily used in, e.g., a transformer. A mold coil is sufficiently short for a given outside diameter and can therefore be implemented by a resin molding. However, when it comes to the induction coil for the heat roller having an elongate, small diameter cylindrical configuration, fluidity available with resin is too low to implement a molding.

Technologies relating to the present invention are disclosed in, e.g., Japanese Patent Laid-Open Publication Nos. 8-194399 and 9-127813.

SUMMARY OF THE INVENTION

It is therefore an object of the present invention to provide an induction heating type fixing device including an induced current generating member exhibiting a desirable cooling effect.

It is another object of the present invention to provide a method of producing the above induced current generating member.

In accordance with the present invention, an induction heating type fixing device includes a body to be heated and formed of a conductive material, and an induced current generating member disposed in the body to be heated. The induced current generating member includes a hollow cylindrical body formed of a heat-resistant insulating material and forming the outermost layer, an adhesive layer, and a induction coil contacting the inner periphery of the adhesive layer.

Also, in accordance with the present invention, a method of producing an induced current generating member for an induction heating type fixing device includes the steps of winding a coil round a bobbin applied with an adhesion preventing material, adhering the coil with nonconductive adhesive by impregnation and inserting the coil into a hollow cylindrical body, and adhering the coil to the hollow cylindrical body and pulling out the bobbin.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENT

Figure 1:
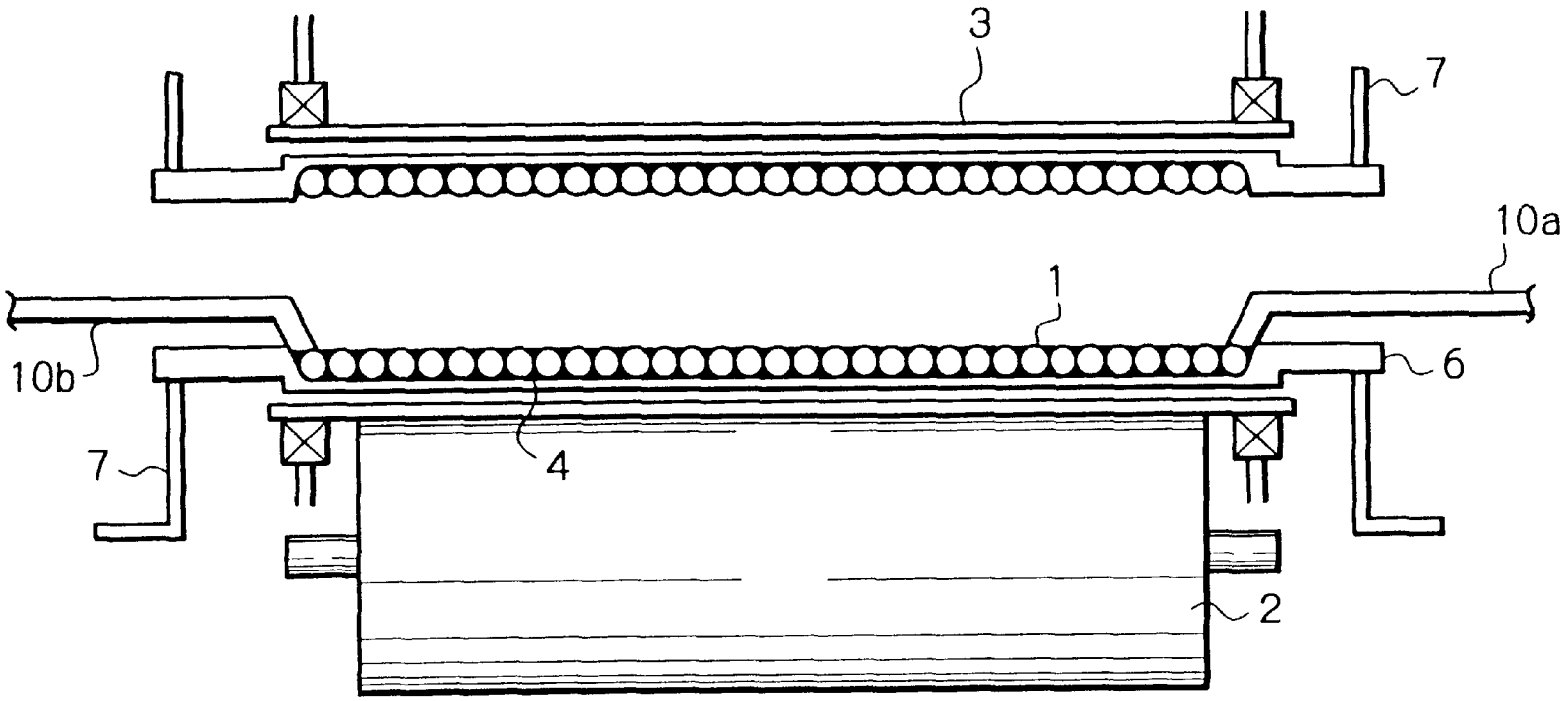
FIG. 1 is a sectional view of a fixing device embodying the present invention in a plane containing the axis of a heat roller.
Figure 2:
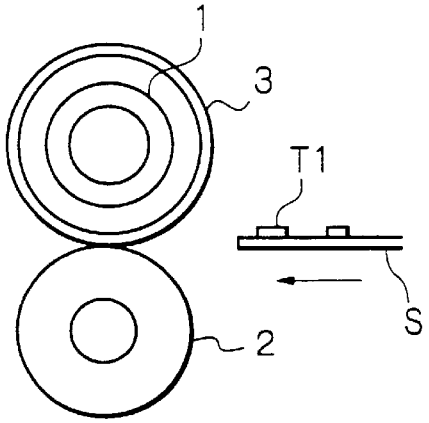
FIG. 2 is a sectional view of the illustrative embodiment in a plane perpendicular to the axis of the heat roller.

Referring to FIGS. 1 and 2 of the drawings, an induction heating type fixing device embodying the present invention is shown. As shown, the fixing device includes a press roller 2 and a heat roller 3 pressed against each other. The press roller 2 and heat roller 3 are rotatable counterclockwise and clockwise, respectively, as seen in FIG. 2. A gear, not shown, is mounted on one axial end of the heat roller 3 and held in mesh with a drive gear not shown. The drive gear causes the heat roller 3 to rotate via the above gear meshing therewith. The heat roller 3 is made up of a core formed of stainless steel, iron or similar magnetic material, and a parting layer covering the core and formed of fluorocarbon resin.

An induction coil 1 is disposed in the heat roller 3 and implemented, e.g., a litz wire. The induction coil 1 forms a part of an induced current generating member. Brackets 7 are supported by opposite side walls of the fixing device while a heat-resistant insulating member 6 having a hollow cylindrical configuration is affixed to the brackets 7. The induction coil 1 is affixed to the inner periphery of the insulating member 6 by nonconductive adhesive 4 and therefore not rotatable. Leads 10*a* and 20*b* extend out from opposite ends of the induction coil 1, so that a high frequency current can be fed to the coil 1 via the lads 10*a* and 10*b*.

In operation, a high frequency current flows through the induction coil 1 positioned at the core of the heat roller 3. As a result, the heat roller 3 generates heat due to Joule heat brought about by an induced current. The heat generation is particularly efficient when the induction coil 1 is implemented by a litz wire. A sheet S carrying a toner image T1 thereon is brought to a nip between the press roller 2 and heat roller 3 rotating in the previously mentioned directions. The press roller 2 and heat roller 3 cooperate to fix the toner image T1 on the sheet S with heat and pressure while conveying the sheet S in a direction indicated by an arrow in FIG. 2.

Figure 3:
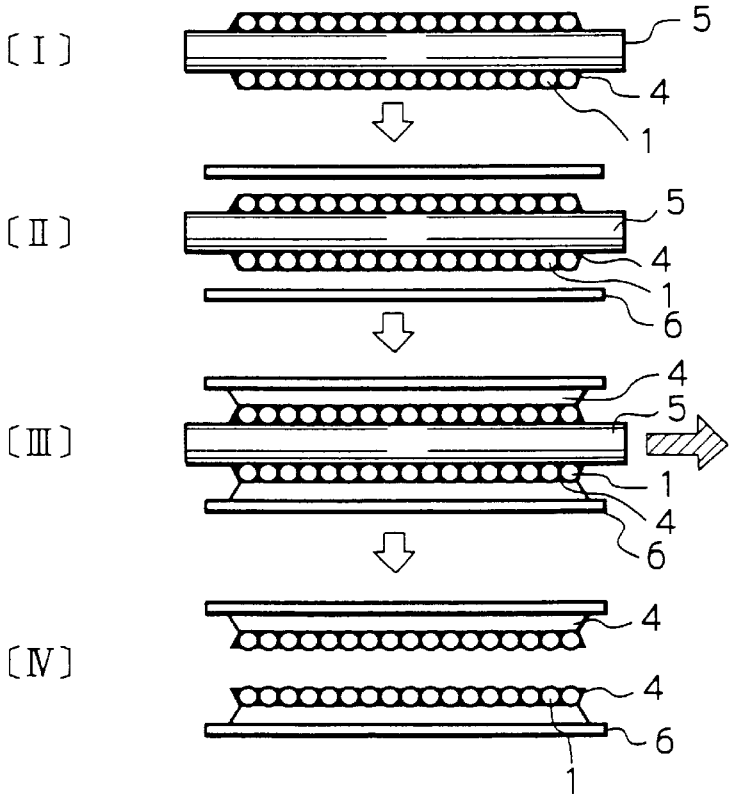
FIG. 3 shows a specific procedure for producing an induced current generating member included in the illustrative embodiment.

Reference will be made to FIG. 3 for describing a specific procedure for producing the induced current generating member. As shown, the induction coil 1 is wound round a hollow bobbin 5 coated with an adhesion preventing material. Subsequently, the nonconductive adhesive 4 is applied to the coil 1. The adhesive 4 penetrates into the gaps between the turns of the coil 1 by impregnation and thereby adheres the turns of the coil 1. The resulting subassembly is shown in FIG. 3, [I]. As shown in FIG. 3, [II], the above subassembly is inserted into a hollow cylindrical body 6 formed of resin or similar heat-resistant insulating material and then affixed to the inner periphery of the body 6 by the nonconductive adhesive 4 (or by usual adhesive). After the adhesive 4 has been cured, the bobbin 5 is removed form the coil 1, as indicated by an arrow in FIG. 3, [III]. FIG. 3, [IV], shows the resulting assembly in which the coil or bobbinless coil 1 is affixed to the inner periphery of the insulating body 6.

While the above procedure uses the nonconductive adhesive 4 twice, it may be replaced with the steps of applying the nonconductive adhesive 4 to the inner periphery of the insulating body 6, inserting the bobbin 5 coated wit an adhesion preventing material and carrying the coil 1 into the insulating body 6, and then pulling out the bobbin 5 after the adhesion of the coil 1 to the body 6. Further, there may be effected the steps of winding the coil 1 round the bobbin 5 to which an adhesion prevention material has been applied, impregnating the coil 1 with the nonconductive adhesive 4, inserting the bobbin and coil subassembly into the insulating body 6, and pulling out the bobbin 5 after the adhesion of the coil 1 to the body 6.

Figure 4:
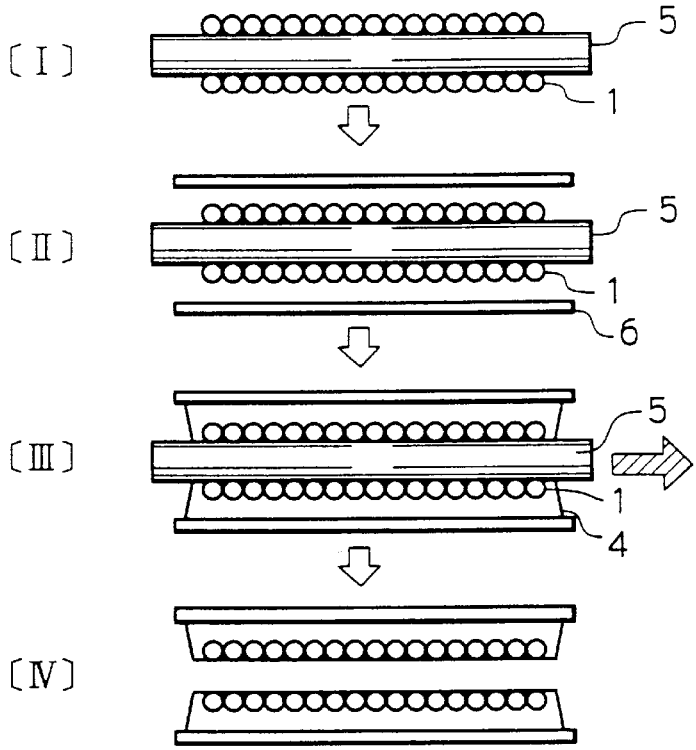
FIG. 4 shows another specific procedure for producing the induced current generating member.

FIG. 4 shows another specific procedure for producing the induced current generating member. As shown in FIG. 4, [I], after the application of an adhesion preventing material to the bobbin 5, the coil 1 is wound round the bobbin 5. Then, as shown in FIG. 4, [II], the bobbin and coil subassembly is inserted into the hollow cylindrical insulating body 6. Subsequently, the nonconductive adhesive 4 is introduced into the gap between the coil 1 and the insulating body 6. After the adhesive 4 has been cured, the bobbin 5 is pulled out, as indicated by an arrow in FIG. 4, [III]. FIG. 4, [IV], shows the resulting assembly in which the coil or bobbinless coil 1 is affixed to the inner periphery of the insulating body 6.

Figure 5:
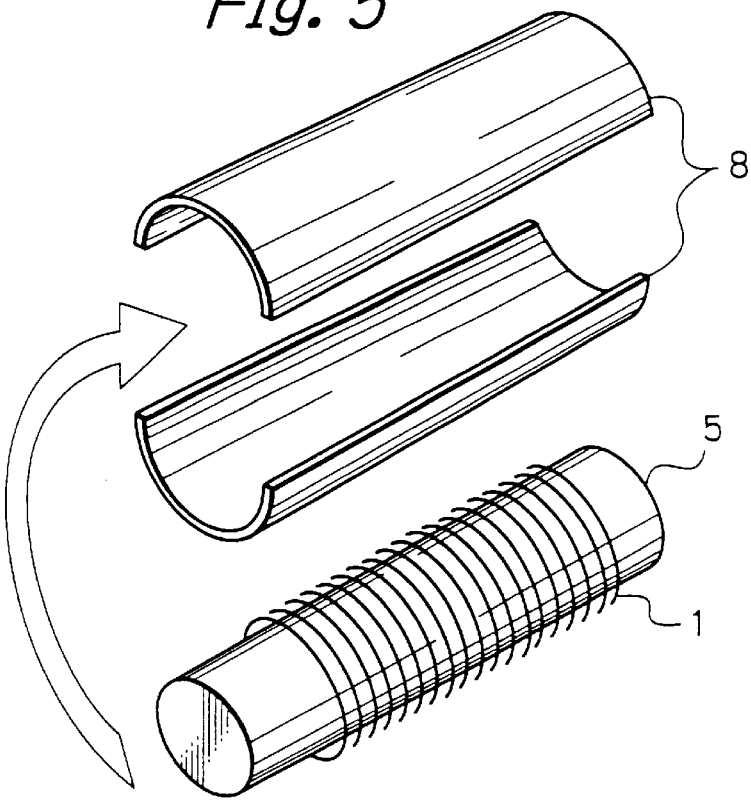
FIG. 5 is an exploded view showing still another specific procedure for producing the induced current generating member.

FIG. 5 shows still another specific procedure for producing the induced current generating member. As shown, the induction coil 1 is wound round the bobbin 5 formed of an adhesion preventing material itself. Then, the coil and bobbin subassembly is sandwiched between two semicylindrical parts 8 forming a cylinder when combined. After the coil and semicylindrical parts 8 have been adhered by the nonconductive adhesive, the bobbin 6 is pulled out, as in the procedure shown in FIG. 4.

In any one of the above specific procedures, the leads of the induction coil 1 should preferably be coated with an adhesion preventing material in order to prevent the adhesive from depositing and solidifying on the leads. For the adhesion preventing material, use may be made of mineral oil, fluorocarbon resin or silicone resin. The crux is that because the outer circumference of the coil 1 is insulated by the nonconductive adhesive by impregnation, the adhesion preventing material can prevent the coil 1 and bobbin 5 from being adhered together by the adhesive intervening between the insulating body 6 or the semicylindrical parts 8 and coil 1.

The cylindrical insulating body or the semicylindrical insulating parts may be formed of polyimide, polyamideimide, fluorocarbon resin, PSS, PPA, PET or similar resin or ceramics. While the bobbin is formed of fluorocarbon resin in order to enhance the non-adhesion effect, the bobbin may be implemented by a metal cylinder coated with fluorocarbon resin.

In summary, it will be seen that the present invention provides an induction heating type fixing device and a method of producing an induced current generating member therefor having various unprecedented advantages, as enumerated below.

(1) The induced current generating member is disposed in a body to be heated which is formed of a conductive material. The induced current generating member is basically made up of a hollow cylinder formed of a heat-resistant insulating material and forming the outermost layer, an adhesive layer, and an induction coil contacting the inner periphery of the adhesive layer. With this configuration, the induced current generating member achieves a desirable cooling effect.

(2) After the coil has been wound round a bobbin coated with an adhesion preventing material, the coil is adhered by nonconductive adhesive by impregnation. The coil is therefore free from loosening, warping or similar deformation. It follows that when the bobbin is pulled out after the adhesion of the coil to the hollow insulating body, the coil remains in the same shape as when it is would round the bobbin. Moreover, an insulating material conventional with the coil enhances an insulation effect and thereby reduces dielectric breakdown ascribable to heat to a significant degree.

(3) The nonconductive adhesive can be surely applied to the necessary portion of the inductive coil or that of the insulating body. This reduced irregularity in adhesion strength and thereby insures stable strength.

(4) The number of production steps is reduced to simplify a production line.

(5) Semicylindrical bodies are adhered to the induction coil in the radial direction of the coil. This, coupled with the above advantages (1)–(4), prevents the adhesive from leaking through a gap between the semicylindrical bodies and the coil.

(6) When the bobbin itself is formed of an adhesion preventing material, the adhesion preventing material does not have to the applied to the bobbin. This additionally simplifies the production line.

(7) When the coil is implemented by a litz wire, a skin effect ascribable to a high frequency current can be reduced. The nonconductive adhesive penetrates into the gaps between the turns of the litz wire and enhances the adhesion effect. This is successful to maintain the shape of the coil.

(8) An adhesion preventing material is applied to leads extending out from opposite ends of the coil and allows the adhesive accidentally deposited on the leads to be easily peeled off. This obviates difficult wiring ascribable to the curing of the above adhesive.

(9) The bobbin and coil are surely prevented from adhering to each other.

(10) Easy removal of the bobbin is further promoted by a parting agent based on fluorine or silicone.

Various modifications will become possible for those skilled in the art after receiving the teachings of the present disclosure without departing from the scope thereof.

What is claimed is:

1. A method of producing an induced current generating member for an induction heating type fixing device, said method comprising the steps of:

(a) applying an adhesion preventing material to a bobbin and winding a coil around said bobbin;

(b) sandwiching said bobbin and said coil wound thereon between a pair of semicylindrical parts to form a hollow cylindrical body surrounding said bobbin and said coil; and (c) adhering said coil to said surrounding hollow cylindrical body and pulling out said bobbin.

2. The method as claimed in claim 1, wherein said coil comprises a litz wire.

3. The method as claimed in claim 1, wherein an adhesion preventing material is applied to leads extending out from opposite ends of said coil.

4. The method as claimed in claim 1, wherein the adhesion preventing material applied to said bobbin contains mineral oil or a silicone-based material as a major component.

5. The method as claimed in claim 1, wherein the adhesion preventing material applied to said bobbin contains a fluorine-based material.

6. The method as claimed in claim 1, wherein said semicylindrical parts are each formed of a heat-resistant insulating material and the adhering of step (c) includes adhering said coil to said hollow cylindrical body by using a nonconductive adhesive.

7. The method as claimed in claim 6, wherein said coil comprises a litz wire.

8. The method as claimed in claim 6, wherein an adhesion preventing material is applied to leads extending out from opposite ends of said coil.

9. A method as claimed in claim 6, wherein the adhesion preventing material applied to said bobbin contains mineral oil or a silicone-based material as a major component.

10. The method as claimed in claim 6, wherein the adhesion preventing material applied to said bobbin contains a fluorine-based material.

11. The method as claimed in claim 6, wherein said nonconductive adhesive is a nonconductive resin impregnated into said coil and the adhering of step (c) includes curing of said nonconductive resin before pulling out said bobbin.

12. The method as claimed in claim 11, wherein said coil comprises a litz wire.

13. The method as claimed in claim 11, wherein an adhesion preventing material is applied to leads extending out from opposite ends of said coil.

14. The method as claimed in claim 11, wherein the adhesion preventing material applied to said bobbin contains mineral oil or a silicone-based material as a major component.

15. The method as claimed in claim 11, wherein the adhesion preventing material applied to said bobbin contains a fluorine-based material.

16. A method of producing an induced current generating member for an induction heating type fixing device, said method comprising the steps of:

(a) winding a coil on a bobbin comprising an adhesion preventing material;

(b) sandwiching said bobbin and said coil wound on said bobbin between a pair of semicylindrical parts to form a hollow cylindrical body surrounding said bobbin and said coil; and (c) adhering said coil to said surrounding hollow cylindrical body and pulling out said bobbin.

17. The method as claimed in claim 16, wherein said coil comprises a litz wire.

18. The method as claimed in claim 17, wherein an adhesion preventing material is applied to leads extending out from opposite ends of said coil.

19. The method as claimed in claim 18, wherein a surface of said bobbin contacting said coil includes of fluorocarbon resin or silicone resin.

20. The method as claimed in claim 16, wherein said semicylindrical parts are each formed of a heat-resistant insulating material and the adhering of step (c) includes adhering said coil to said hollow cylindrical body by using a nonconductive adhesive.

21. The method as claimed in claim 20, wherein said coil comprises a litz wire.

22. The method as claimed in claim 21, wherein an adhesion preventing material is applied to leads extending out from opposite ends of said coil.

23. The method as claimed in claim 22, wherein a surface of said bobbin contacting said coil includes fluorocarbon resin or silicone resin.

24. The method as claimed in claim 20, wherein said nonconductive adhesive is a nonconductive resin impregnated into said coil and the adhering of step (c) includes curing of said nonconductive resin before pulling out said bobbin.

25. The method as claimed in claim 24, wherein said coil comprises a litz wire.

26. The method as claimed in claim 25, wherein an adhesion preventing material is applied to leads extending out from opposite ends of said coil.

27. The method as claimed in claim 26, wherein a surface of said bobbin contacting said coil includes fluorocarbon resin or silicone resin.

28. A method of producing an induced current generating member for an induction heating type fixing device, said method comprising the steps of:

(a) applying an adhesion preventing material to a bobbin and winding a coil around said bobbin;

(b) sandwiching said bobbin and said coil wound thereon between a pair of semicylindrical parts that are each formed of a heat-resistant insulating material to form a hollow cylindrical body surrounding said bobbin and said coil;

(c) introducing nonconductive adhesive into a gap between said coil and an inner periphery of said hollow cylindrical body; and (d) curing said nonconductive adhesive and then pulling out said bobbin.

29. The method as claimed in claim 28, wherein said coil comprises a litz wire.

30. The method as claimed in claim 28, wherein an adhesion preventing material is applied to leads extending out from opposite ends of said coil.

31. The method as claimed in claim 28, wherein the adhesion preventing material applied to said bobbin contains mineral oil or a silicone-based material as a major component.

32. The method as claimed in claim 28, wherein the adhesion preventing material applied to said bobbin contains a fluorine-based material.

33. A method of producing an induced current generating member for an induction heating type fixing device, said method comprising the steps of:

(a) winding a coil on a bobbin comprising an adhesion preventing material;

(b) sandwiching said bobbin and said coil wound thereon between a pair of semicylindrical parts that are each formed of a heat-resistant insulating material to form a hollow cylindrical body surrounding said bobbin and said coil;

(c) introducing a nonconductive adhesive into a gap between said coil and an inner periphery of said hollow cylindrical body; and (d) curing said nonconductive adhesive and then pulling out said bobbin.

34. The method as claimed in claim 33, wherein said coil comprises a litz wire.

35. The method as claimed in claim 34, wherein an adhesion preventing material is applied to leads extending out from opposite ends of said coil.

36. The method as claimed in claim 35, wherein a surface of said bobbin contacting said coil includes fluorocarbon resin or silicone resin.

* * * * *